US006414420B1

(12) United States Patent
Suzuki

(10) Patent No.: US 6,414,420 B1
(45) Date of Patent: Jul. 2, 2002

(54) SPARK PLUG AND METHOD OF MANUFACTURING THE SAME

(75) Inventor: Akira Suzuki, Nagoya (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 09/488,473

(22) Filed: Jan. 20, 2000

(30) Foreign Application Priority Data

Jan. 21, 1999 (JP) ..... 11-013515

(51) Int. Cl.[7] ..... H01T 13/20

(52) U.S. Cl. ..... 313/144; 313/141; 313/143; 313/145; 313/135; 313/137; 313/118

(58) Field of Search ..... 313/135, 137, 313/141, 143, 118, 145

(56) References Cited

U.S. PATENT DOCUMENTS

| | | | | | |
|---|---|---|---|---|---|
| 4,261,085 | A | * | 4/1981 | Nishio et al. | 313/141 |
| 5,962,957 | A | * | 10/1999 | Tanaka et al. | 313/141 |
| 6,046,532 | A | * | 3/2000 | Matsutani et al. | 313/141 |
| 6,130,498 | A | * | 10/2000 | Shimizu et al. | 313/141 |
| 6,137,211 | A | * | 10/2000 | Sugimoto et al. | 313/145 |
| 6,160,342 | A | * | 12/2000 | Nishikawa et al. | 313/141 |
| 6,170,451 | B1 | * | 1/2001 | Moriya | 313/137 |
| 6,191,525 | B1 | * | 2/2001 | Tanaka et al. | 313/141 |
| 6,215,233 | B1 | * | 4/2001 | Natsubara | 313/118 |
| 6,265,816 | B1 | * | 7/2001 | Ito et al. | 313/141 |
| 6,326,719 | B1 | * | 12/2001 | Boehler et al. | 313/141 |

FOREIGN PATENT DOCUMENTS

| | | |
|---|---|---|
| EP | 2 419 600 | 10/1979 |
| EP | 2 179 397 | 3/1987 |
| EP | 196 36 537 | 3/1998 |
| JP | 48-26687 | 8/1973 |
| JP | 5-55489 | 7/1993 |
| JP | 06013156 | 1/1994 |

* cited by examiner

*Primary Examiner*—Sandra O'Shea
*Assistant Examiner*—Anabel Ton
(74) *Attorney, Agent, or Firm*—Finnegan, Henderson, Farabow, Garrett & Dunner L.L.P.

(57) ABSTRACT

A spark plug according to this invention includes an insulator having a center through-hole formed therein, a center electrode held in the center through-hole, a metallic shell holding the insulator by swaging, and a ground electrode electrically connected to the metallic shell and defining a spark discharge gap in cooperation with the center electrode. The metallic shell has a male-threaded portion formed on the outer circumferential surface of a front end portion of the metallic shell, and a tightening portion formed on the outer circumferential surface of the metallic shell, located at a rear side with respect to the male-threaded portion. The tightening portion has a width-across-flats W of not greater than 14 mm. A cushion material is filled into a space defined by the metallic shell and an insulator to form a cushion-material charged portion. The cushion-material charged portion has an axial length L of from 0.5 mm to 10.0 mm inclusive and a thickness M of from 0.5 mm to 1.3 mm inclusive.

4 Claims, 5 Drawing Sheets

SPARK PLUG AND METHOD OF MANUFACTURING THE SAME

CROSS REFERENCE TO RELATED APPLICATION

The present application claims foreign priority from Japanese Patent Application No. Hei 11-013515, filed on Jan. 21, 1999, the content of which is incorporated herein by reference in its entirety.

BACKGROUND OF THE INVENTION

1. Field of the Invention

The present invention relates to a spark plug used as a source of ignition in an internal combustion engine, and more particularly, to a spark plug having a small-sized metallic shell for installation in a narrow space.

2. Description of the Related Art

Some conventional spark plugs employ a cushion material formed from talc powder and filled into a cylindrical space defined by an outer circumferential surface of an insulator and an inner circumferential surface of a metallic shell to improve impact resistance. Other conventional spark plugs do not employ such a cushion material (talc) but are configured such that the insulator is secured directly by the metallic shell through thermal swaging. These conventional spark plugs include a screw diameter of 14 mm (M14) or 12 mm (M12), and a hexagonal tightening portion with which a plug wrench is engaged having a distance of 20.8 mm or 16 mm between two parallel, diagonally opposed surfaces of the hexagonal tightening portion ("width-across-flats").

With recent improvement in engine control technology a tendency toward employing a multi-valve type combustion chamber, the number of components mounted on and around an engine has been increasing. Particularly, in the case of a direct-injection-type engine, which is becoming popular, a volume allot ed to a spark plug on a cylinder head is small. Accordingly, the width-across-flats of a tightening portion of a metallic shell has been required to be decreased from the conventionally employed width of 16 mm to not greater than 14 mm.

When the width-across-flats is reduced to not greater than 14 mm, the wall thickness of a metallic shell decreases accordingly. As a result, the volume of the metallic shell decreases, and thus, the metallic shell decreases in strength. A spark plug having a width-across-flats not greater than 14 mm and not employing a cushion material (talc) suffers impairment in impact resistance and a considerable reduction in airtightness after exposure to impact.

Also, since the wall thickness of a tightening portion decreases, a load imposed on the tightening portion during swaging causes swelling of the tightening portion. As a result, the width-across-flats may fail to fall within a predetermined tolerance, potentially causing a failure to establish engagement between the tightening portion and a plug wrench.

The aforementioned engagement problem will be described specifically with reference to FIGS. 2 and 3. An insulator 1 is fixedly attached to a metallic shell 5 by swaging in the following manner. A swaging die is applied from underneath to a seat portion 5F of the metallic shell 5, while another swaging die is applied from above to a tightening portion 5A and a swaging portion 5C. The upper swaging die exerts a downward force to buckle a curved portion 5D by about 0.5 mm to 0.8 mm, whereby the insulator 1 is strongly pressed against an inner stepped portion 5E of the metallic shell 5 via a packing member 6. In this manner, the insulator 1 is fixedly attached to the metallic shell 5 through swaging. During such swaging, a strong force exerted by the upper swaging die causes plastic deformation of not only the curved portion 5D but also the tightening portion 5A. As a result, the tightening portion 5A swells slightly. This swelling has not raised a problem with respect to a conventional spark plug having a width-across-flats W of not less than 16 mm, since a wall thickness P of the tightening portion 5A is sufficiently thick so that the tightening portion 5A has a sufficient strength.

However, a spark plug having a width-across-flats of not greater than 14 mm encounters a difficulty in bringing the width-across-flats W within a predetermined tolerance, since the wall thickness P of the tightening portion 5A is thin and results in significant swelling of the tightening portion 5A. Unless the width-across-flats W falls within a predetermined tolerance, a plug wrench cannot be engaged with the tightening portion 5A. By contrast, when, in order to reduce the swelling of the tightening portion 5A, the wall thickness of the curved portion 5D is reduced so that a forced required to buckle the curved portion 5D can be reduced, the strength of the curved portion 5D of a spark plug becomes insufficient for enduring a tightening torque exerted when the spark plug is mounted on an engine. Alternatively, when a thickness M of talc 9 serving as a cushion material is reduced to accordingly increase the wall thickness P of the tightening portion 5A, the effect of the talc 9 as a cushion material is diminished, resulting in an impairment in impact resistance.

SUMMARY OF THE INVENTION

An object of the present invention is to provide a spark plug capable of exhibiting high impact resistance even when the width-across-flats of a tightening portion of a metallic shell is small, and capable of maintaining airtightness even after subjection to strong impact.

Another object of the present invention is to provide a spark plug having further improved impact resistance and capable of bringing the width-across-flats of a tightening portion into a predetermined tolerance through suppression of swelling of the tightening portion.

A further object of the present invention is to provide a method of manufacturing a spark plug as mentioned above.

Additional objects and advantages of the invention will be set forth in part in the description which follows, and in part will be obvious from the description, or may be learned by practice of the invention. The advantages and purpose of the invention will be realized and attained by the elements and combinations particularly pointed out in the appended claims.

To achieve the above objects, the present invention provides a spark plug including an insulator having a center through-hole formed therein, a center electrode held in the center through-hole, a metallic shell holding the insulator by swaging, and a ground electrode electrically connected to the metallic shell and defining a spark discharge gap in cooperation with the center electrode. The metallic shell has a male-threaded portion formed on the outer circumferential surface of a front end portion of the metallic shell, and a tightening portion formed on the outer circumferential surface of the metallic shell, located at a rear side with respect to the male-threaded portion. In the specification, the term "front" refers to a spark discharge gap side with respect to an axial direction of the center electrode, and the term "rear" refers to a side opposite the front side.

The tightening portion is used to screw the male-threaded portion into a female-threaded hole formed in an internal combustion engine. The distance between two opposed parallel surfaces of the tightening portion (hereinafter referred to as a width-across-flats W) is not greater than 14 mm (W≦14.0 mm).

A cushion material is charged into a cylindrical space defined by an outer surface of the insulator and an inner surface of the metallic shell to thereby form a cushion-material charged portion. The cushion-material charged portion has an axial length L of from 0.5 mm to 10.0 mm inclusive (0.5 mm≦L≦10.0 mm) and a thickness M of from 0.5 mm to 1.3 mm inclusive (0.5 mm≦M≦1.3 mm). The cylindrically filled cushion material eases impact exerted on the metallic shell, thereby preventing loosening of swaging between the metallic shell and the insulator even when the width-across-flats is not greater than 14 mm. Even when swaging between the metallic shell and the insulator loosens to some extent and thus the pressure produced at the packing potion between the metallic shell and the insulator decreases with a resultant leakage of combustion gas through the packing portion, the cushion-material charged portion serves as a second packing to prevent leakage of the combustion gas from the spark plug.

When the axial length L of the cushion-material charged portion is less than 0.5 mm, the cushion-material charged portion fails to effect cushioning as expected. When the axial length L of the cushion-material charged portion is in excess of 10 mm, the cushion material cannot be sufficiently filled into the cylindrical space. The resultant cushion-material charged portion has a low cushion material density and thus fails to effect cushioning as expected. When the thickness M of the cushion-material charged portion is less than 0.5 mm, the cushion-material charged portion fails to effect cushioning as expected. When the thickness M of the cushion-material charged portion is in excess of 1.3 mm, the wall thickness of the tightening portion of the metallic shell decreases accordingly, resulting in an impairment in the strength of the metallic shell.

Accordingly, even when the width-across-flats is not greater than 14 mm, the spark plug endures use at high temperature and exhibits excellent impact resistance.

Preferably, the metallic shell has a seat portion located between the male-threaded portion and the tightening portion and has a diameter greater than that of the male-threaded portion, and a curved portion which extends between the tightening portion and the seat portion. The curved portion is buckled through axial swaging while being heated to integrate the metallic shell and the insulator into a single unit.

Through employment of the above-mentioned swaging combined with heating; i.e., hot swaging, a load required for swaging; i.e., a load required for buckling of the curved portion, becomes smaller than that required for cold swaging. Therefore, the load imposed on the tightening portion during swaging is decreased accordingly. Even in the case of the tightening portion having a thin wall thickness, swelling of the tightening portion becomes sufficiently small so as to bring the width-across-flats within a predetermined tolerance. Also, when the heated curved portion cools after swaging, the curved portion shrinks axially, so that the pressure produced at the packing portion through swaging further increases to thereby improve airtightness of the spark plug.

Notably, whether a spark plug has been formed through employment of hot swaging or cold swaging can be easily determined through analysis of a halved piece of the spark plug. In a spark plug formed through employment of hot swaging, a buckled curved portion exhibits swelling in radially inward and outward directions; i.e., the curved portion is deformed such that the thickness thereof is increased. By contrast, in a spark plug formed through employment of cold swaging, the buckled curved portion is deformed in either a radially inward direction or a radially outward direction.

The present invention further provides a method of manufacturing a spark plug including an insulator having a center through-hole formed therein, a center electrode held in the center through-hole, a metallic shell holding the insulator through swaging, a ground electrode electrically connected to the metallic shell and defining a spark discharge gap in cooperation with the center electrode, and a ground electrode electrically connected to the metallic shell and defining a spark discharge gap in cooperation with the center electrode. The metallic shell has a male-threaded portion formed on the outer circumferential surface of a front end portion of the metallic shell and a tightening portion formed on the outer circumferential surface of the metallic shell, located at a rear side with respect to the male-threaded portion. The tightening portion is used to screw the male-threaded portion into a female-threaded hole formed in an internal combustion engine.

The method includes the steps of: forming the metallic shell such that the distance between two opposed parallel surfaces of the tightening portion (hereinafter referred to as a width-across-flats W) is not greater than 14 mm (W≦14.0 mm) and that the metallic shell has a seat portion located between the male-threaded portion and the tightening portion and has a diameter greater than that of the male-threaded portion, and a curved portion that extends between the tightening portion and the seat portion; charging a cushion material into a cylindrical space defined by an outer surface of the insulator and an inner surface of the metallic shell to thereby form a cushion-material charged portion having an axial length L of from 0.5 mm to 10.0 mm inclusive (0.5 mm≦L≦10.0 mm) and a thickness M of from 0.5 mm to 1.3 mm inclusive (0.5 mm≦M≦1.3 mm); and pressing the tightening portion and the seat portion toward each other while applying current thereto so as to heat the curved portion, to thereby buckle the curved portion.

Through employment of the above-mentioned steps, a load required for swaging can be decreased. Thus, a spark plug manufactured by the above method yields the effects mentioned previously. Also, swelling of the tightening portion can be reduced to a practically acceptable extent.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

In accordance with the invention, a spark plug including an insulator having a center through-hole formed therein, a center electrode held in the center through-hole, a metallic shell holding the insulator by swaging, and a ground electrode electrically connected to the metallic shell and defining a spark discharge gap in cooperation with the center electrode. The metallic shell has a male-threaded portion formed on the outer circumferential surface of a front end portion of the metallic shell, and a tightening portion formed on the outer circumferential surface of the metallic shell, located at a rear side with respect to the male-threaded portion. The distance between two opposed parallel surfaces of the tightening portion is not greater than 14 mm ($W \leqq 14.0$ mm). A cushion material is charged into a cylindrical space defined by an outer surface of the insulator and an inner surface of the metallic shell to form a cushion-material charged portion. The cushion-material charged portion has an axial length L of from 0.5 mm to 10.0 mm inclusive ($0.5 \text{ mm} \leqq L \leqq 10.0$ mm) and a thickness M of from 0.5 mm to 1.3 mm inclusive ($0.5 \text{ mm} \leqq M \leqq 1.3$ mm).

Figure 1:
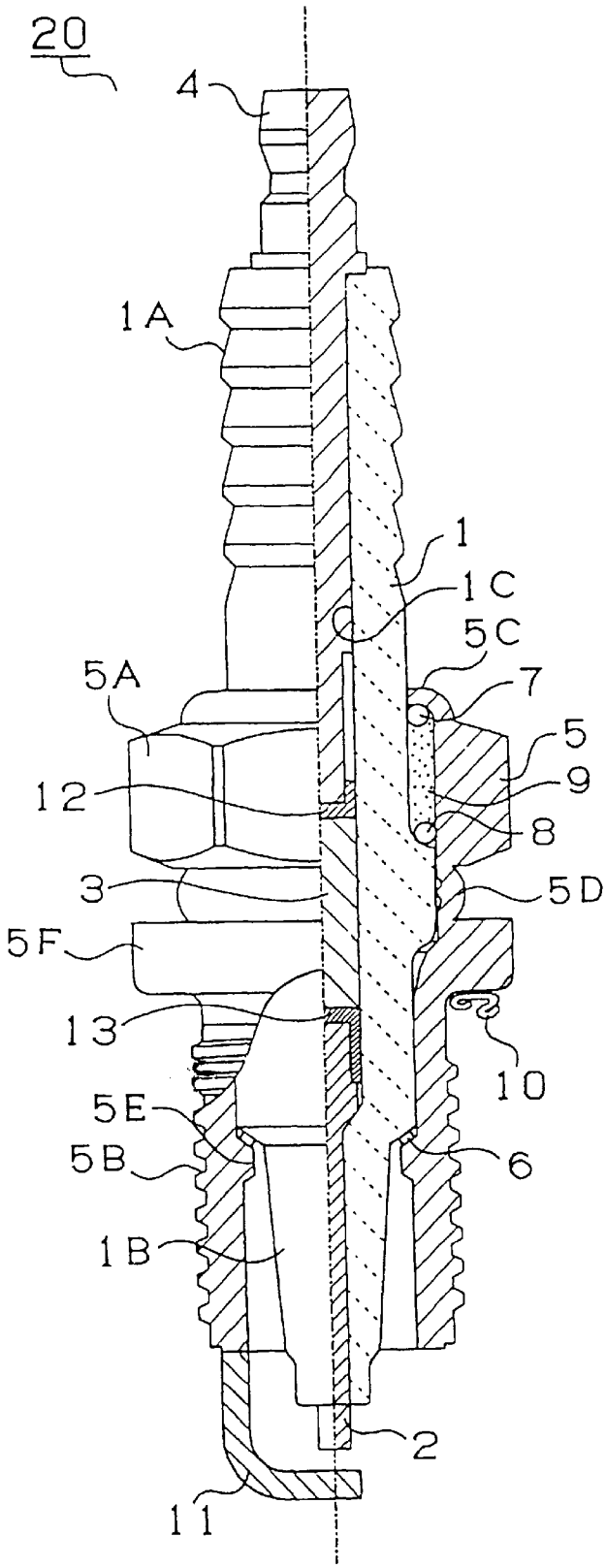
FIG. 1 is a partially sectional view of a spark plug according to the present invention.

FIG. 1 shows a spark plug 20 according to the present invention. An insulator 1 made of, for example, alumina has corrugations 1A formed at an upper portion to provide an increased creeping distance, and has a leg portion 1B formed at a lower portion and adapted to be exposed to the interior of the combustion chamber of an internal combustion engine. A center through-hole 1C is formed axially in the insulator 1. A center electrode 2 made of a nickel alloy, such as inconel, is held in the center through-hole 1C and protrudes from the lower end of the insulator 1. The center electrode 2 is not simply made of inconel, but includes a copper core extending axially within an inconel body in order to improve thermal conductivity. FIG. 1 does not show the copper core in interest of simplicity of the drawing. The center electrode 2 is electrically connected to a terminal 4 located at the top of the spark plug 20 via conductive glass seal layers 12 and 13 and a resistor 3 provided within the center through-hole 1C. An unillustrated high-tension cable is connected to the terminal 4 to apply high voltage to the terminal 4. The insulator 1 rests in a metallic shell 5.

Figure 5A:
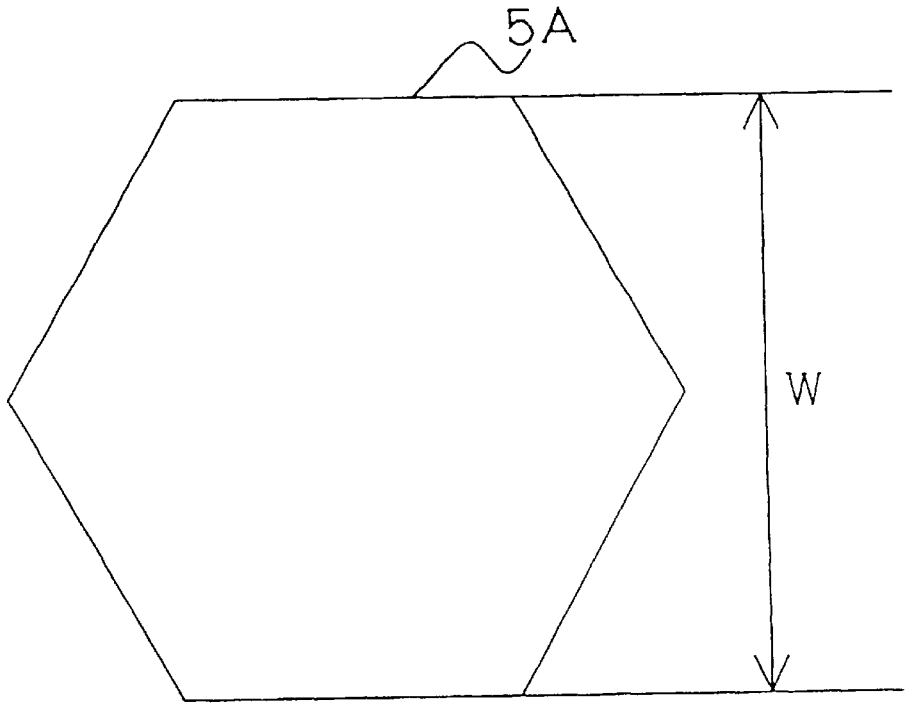
FIG. 5A is a schematic plan view of a hexagonal portion of a metallic shell.

The metallic shell 5 is made of low-carbon steel, and includes a hexagonal portion 5A serving as a tightening portion of the present invention and adapted to engage a spark plug wrench, a male-threaded portion 5B to be screwed into a cylinder head, and a seat portion 5F. As shown in FIG. 5A, the circumferential surface of the hexagonal portion 5A assumes a hexagonal profile of a hexagonal nut. The metallic shell 5 is swaged to the insulator 1 by means of a swaging portion 5C, whereby the metallic shell 5 and the insulator 1 are integrated into a single unit. A curved portion 5D extending between the hexagonal portion 5A and the seat portion 5F is adapted to absorb an axial deformation of the metallic shell 5 that accompanies swaging. In order to complement sealing effected by swaging, a sheetlike packing member 6 is disposed between an inner circumferential stepped portion 5E of the metallic shell 5 and the insulator 1 to seal an upper portion of the insulator 1 from the leg portion 1B exposed to the interior of the combustion chamber. Wire-like sealing members 7 and 8 are disposed between the swaging portion 5C and the insulator 1. Talc powder 9 serving as a cushion material is charged between the sealing members 7 and 8 to establish elastic sealing, thereby fixedly and completely engaging the metallic shell 5 and the insulator 1 together. A gasket 10 is disposed at an upper end of the male-threaded portion 5B. A ground electrode 11 made of nickel alloy is welded to the lower end of the metallic shell 5. The ground electrode 11 is bent at a right angle such that a flat surface of an end portion of the ground electrode 11 faces a tip end of the center electrode 2.

Figure 2:
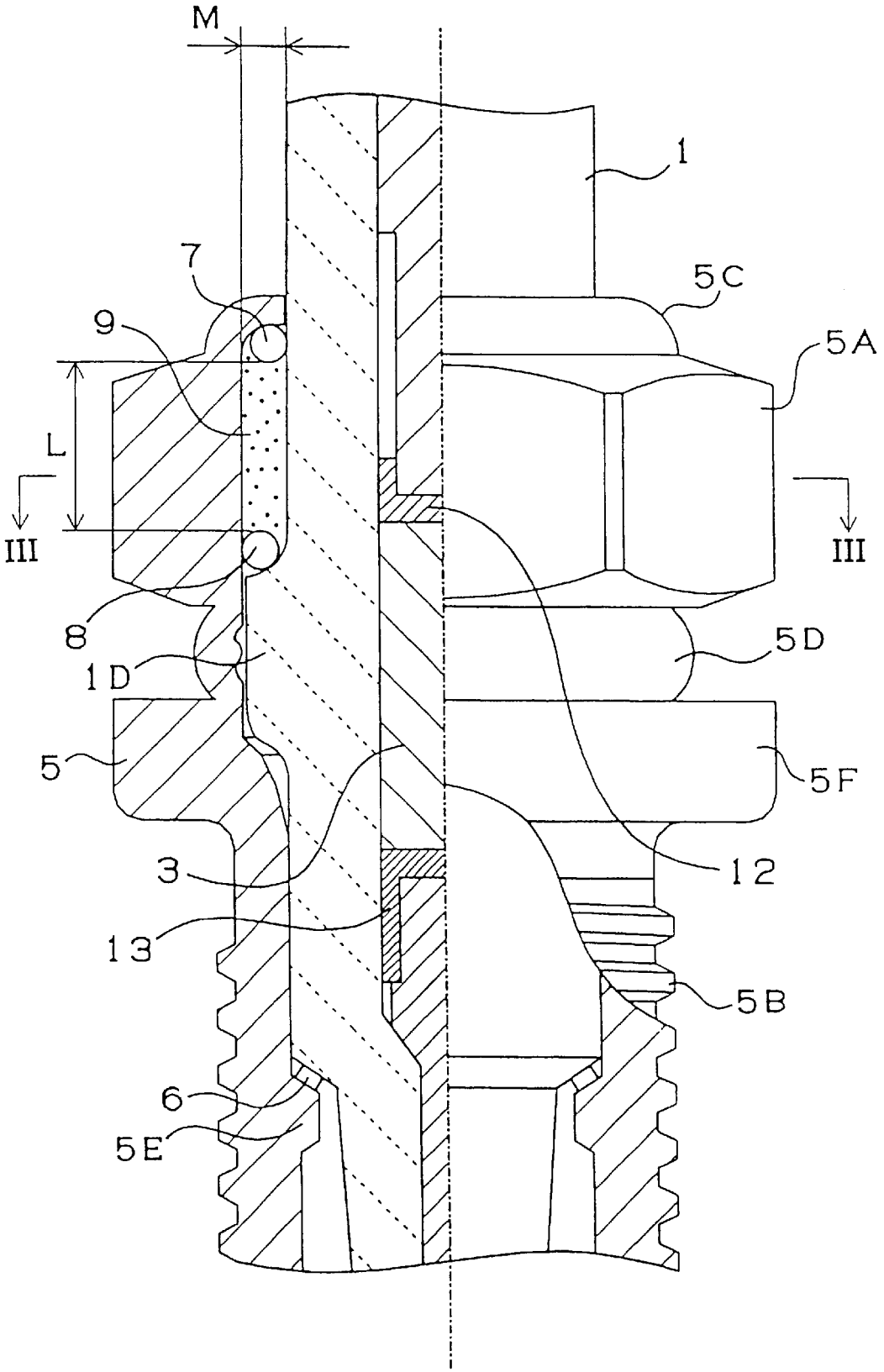
FIG. 2 is a partially sectional view of a portion of a metallic shell subjected to swaging.
Figure 3:
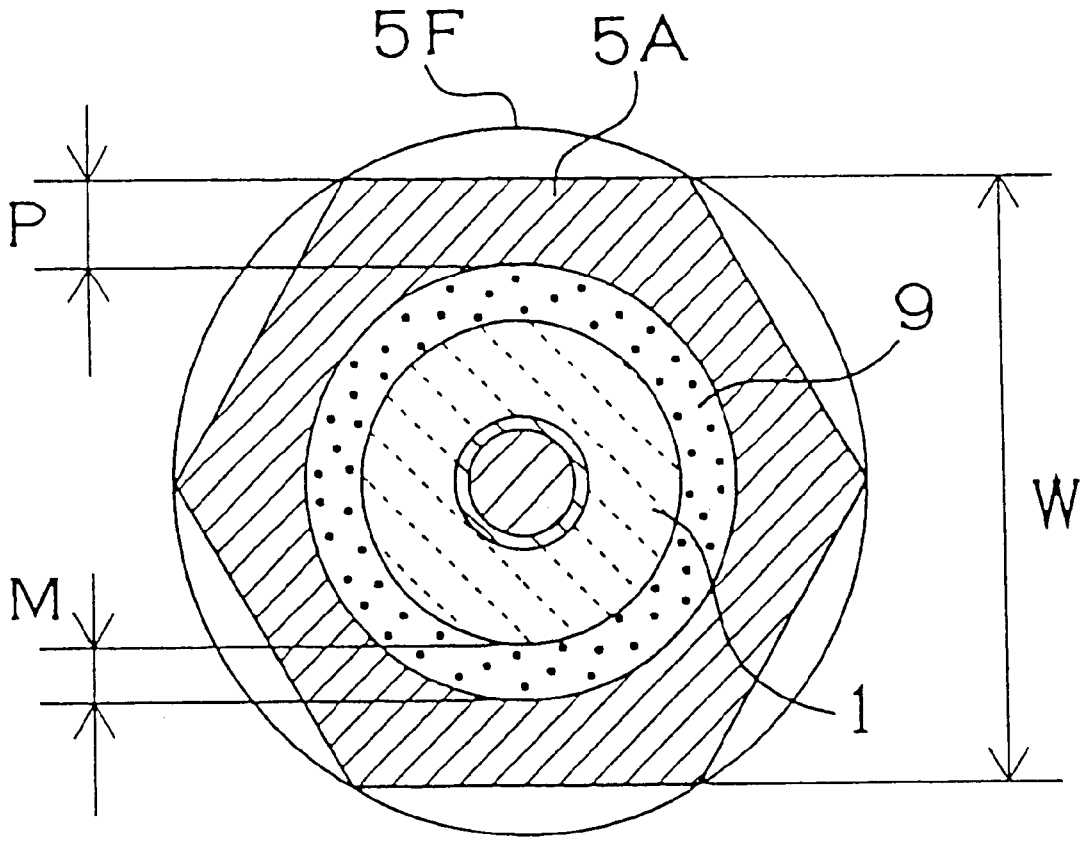
FIG. 3 is a sectional view taken along line III—III of FIG. 2.
Figure 4:
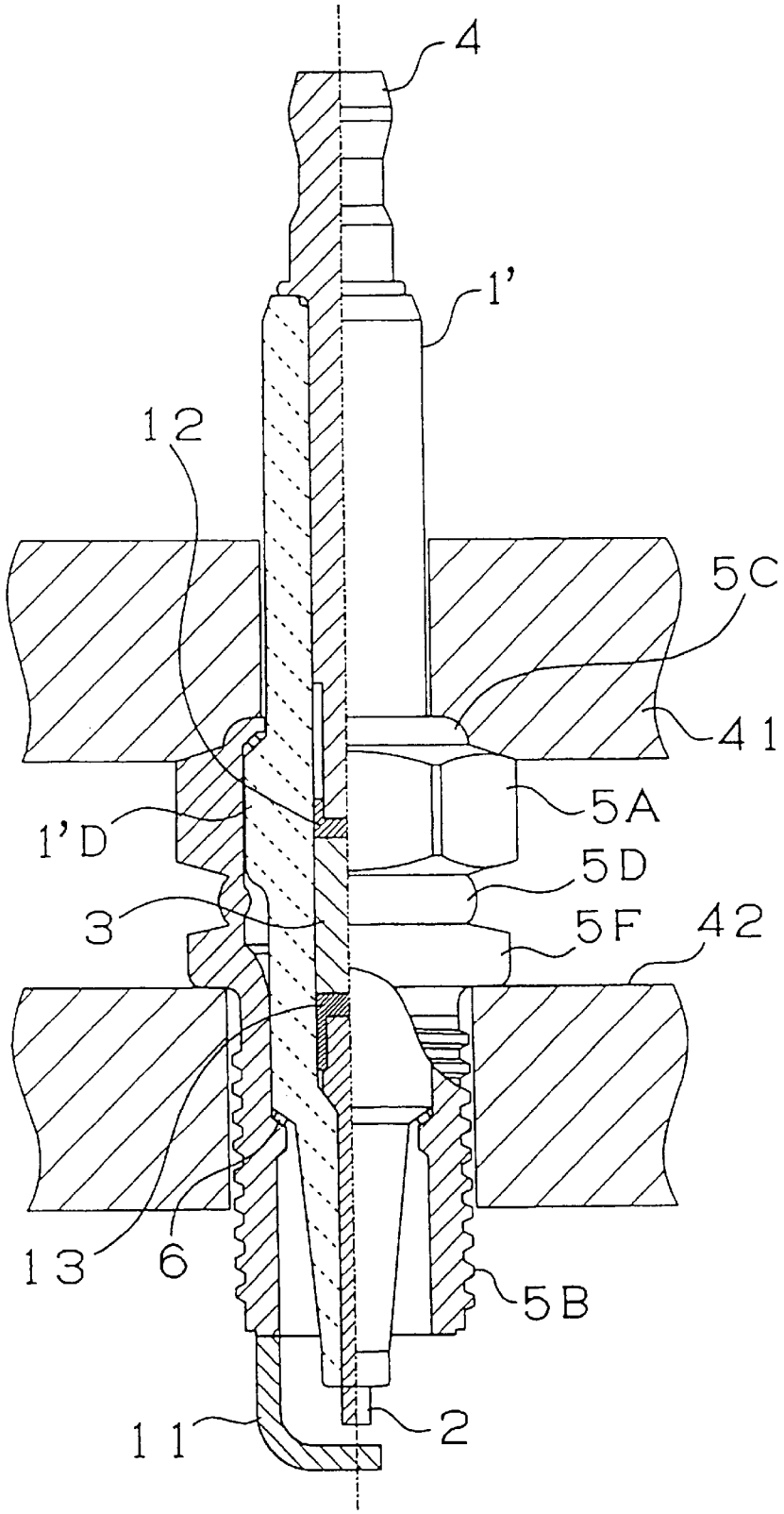
FIG. 4 is a partially sectional view showing a step of swaging a spark plug that does not have a cushion-material charged portion.

Referring to FIGS. 2 and 3, the outer circumferential surface of the insulator 1, the inner circumferential surface of the hexagonal portion 5A, and the upper and lower sealing members 7 and 8 define a cylindrical space into which the talc powder is charged, thereby forming a cushion-material charged portion 9. As shown in FIG. 4, a lower swaging die 42 is brought into contact with the lower surface of the seat portion 5F of the metallic shell 5, and an upper swaging die 41 is brought into contact with the swaging portion 5C and the upper surface of the hexagonal portion 5A. The upper and lower dies 41 and 42 are pressed toward each other at a load of several tons to press the metallic shell 5.

Through application of the above load, as shown in FIG. 2, the swaging portion 5C is deformed along the surface of the upper die 41, and the thin-walled, curved portion 5D is plastically deformed, or buckled, in an amount of about 0.8 mm in the axial direction. This axial buckling causes the swaging portion 5C to strongly press an outer circumferential stepped portion 1D of the insulator 1 downwardly via the sealing member 8, the talc powder 9, and the sealing member 7. As a result, the insulator 1 is strongly pressed against an inner circumferential stepped portion 5E of the metallic shell 5 via the packing member 6, thereby sealing an upper portion of the insulator 1 from the leg portion 1B exposed to the interior of the combustion chamber. A strong force exerted on the talc powder 9 causes the hexagonal portion 5A of the metallic shell 5 to slightly, elastically swell in the radial direction. This elastic swelling of the hexagonal portion 5A induces a radially inward force similar to a spring force, which presses downward the outer circumferential stepped portion 1D of the insulator 1 via the talc powder 9. This downward force elastically presses the insulator 1 against the inner circumferential stepped portion 5E of the metallic shell 1 via the packing member 6. Thus, sealing effected by the packing member 6 becomes more elastic, thereby imparting excellent impact resistance on the spark plug 20.

FIG. 4 illustrates a step of swaging a spark plug that does not have a cushion-material charged portion (talc) 9. An outer circumferential stepped portion 1'D of an insulator 1' is elongated axially such that the swaging portion 5C of the metallic shell abuts the upper end of the outer circumferential stepped portion 1'D either directly or via a sealing material. The lower swaging die 42 is brought into contact with the lower surface of the seat portion 5F of the metallic shell 5, and the upper swaging die 41 is brought into contact with the swaging portion 5C and the upper surface of the hexagonal portion 5A. The upper and lower dies 41 and 42 are pressed toward each other at a load of several tons so as to press the metallic shell 5. In this state, a current of about 100 A is applied between the upper and lower dies 41 and 42 for a period of 0.5 sec. to 1 sec. The current flows from the upper die 41 to the lower die 42 through the metallic shell; specifically, through the hexagonal portion 5A, the curved portion 5D, and the seat portion 5F. Since the curved portion 5D has the thinnest thickness and thus has the highest resistance, only the curved portion 5D is intensively heated and is thus red-heated. Thus, the curved portion 5D is softened, so that a load required to buckle the curved portion 5D is decreased. A load required for swaging is decreased accordingly. As the heated, curved portion 5D cools after completion of hot swaging, the curved portion 5D shrinks in the axial direction, thereby further increasing the packing pressure of the packing member 6 produced through swaging and thus improving airtightness of the spark plug.

Hot swaging of the spark plug not having the cushion-material charged portion 9 has been described with reference to FIG. 4. However, a spark plug having the cushion-material charged portion 9 as shown in FIG. 2 may undergo hot swaging while current is applied to the metallic shell 5 through the swaging dies 41 and 42. Through employment of hot swaging, a load required to buckle the curved portion 5D decreases 30% or more, thereby reducing swelling of the hexagonal portion 5A associated with swaging to a practically acceptable extent. As the heated, curved portion 5D cools after completion of hot swaging, the curved portion 5D shrinks, and airtightness of the spark plug is improved. To test the effect of hot swaging, a number of spark plugs were prepared. The spark plugs were divided into three groups: plugs A, B, and C. Plug A is a spark plug that has the cushion-material charged portion 9 and that has undergone cold swaging; plug B is a spark plug that has the cushion-material charged portion 9 and that has undergone hot swaging; and plug C is a spark plug that does not have the cushion-material charged portion 9 and that has undergone hot swaging.

The tested spark plugs have the following dimensions. The male-threaded portion 5B of the metallic shell 5 has a diameter of 12 mm, or M12. The width-across-flats W of the hexagonal portion 5A is 14 mm with a tolerance of +0.0 mm and −0.27 mm. The wall thickness P of the hexagonal portion 5A is 1.0 mm. The cushion-material charged portion 9 has an axial length L of 7.0 mm and a thickness M of 1.0 mm.

The spark plugs underwent an impact test and a heating test and were then tested for hot airtightness. The impact test was conducted according to Section 6.4 "Impact Test" of JIS B 8031. A spark plug was attached to a block having a mass of 2.3 kg. The block was hit against an anvil 400 times per minute while being biased by a spring, thereby exerting impact on the spark plug. According to JIS regulations, impact was to be exerted for 10 minutes. However, in this test, impact was exerted for 30 minutes. The heating test was conducted simultaneously with the impact test. By use of a burner, a spark portion of the spark plug was heated to about 800° C., and the seat temperature was increased to about 300° C.

The spark plug that had undergone the impact and heating tests was subjected to a hot airtightness test, which was carried out in the following manner. After the spark plug was allowed to stand at a predetermined ambient temperature for 30 minutes, an air pressure of 15 kgf/cm$^2$ was applied to the spark portion. The amount of air leakage from the interior of the spark plug was measured at various ambient temperatures. The results are shown in Table 1.

TABLE 1

Hot Airtightness as Measured after Heating and Impact Tests

| Type | Room temp. | 50° C. | 100° C. | 150° C. | 200° C. | 250° C. | 300° C. |
|---|---|---|---|---|---|---|---|
| Plug A | AA | AA | AA | BB | CC | CC | CC |
| | AA | AA | BB | BB | CC | CC | CC |
| | AA | AA | AA | BB | BB | CC | CC |
| | AA | AA | AA | BB | CC | CC | CC |
| | AA | AA | BB | CC | CC | CC | CC |
| Plug B | AA | AA | AA | AA | BB | BB | CC |
| | AA | AA | AA | AA | BB | BB | CC |
| | AA | AA | AA | AA | BB | CC | CC |
| | AA | AA | AA | AA | BB | CC | CC |
| | AA | AA | AA | AA | BB | CC | CC |
| Plug C | CC | CC | CC | CC | CC | CC | CC |
| | CC | CC | CC | CC | CC | CC | CC |
| | BB | BB | CC | CC | CC | CC | CC |
| | CC | CC | CC | CC | CC | CC | CC |
| | BB | BB | CC | CC | CC | CC | CC |

In Table 1, AA denotes a leakage of 0 cc per minute; BB denotes a leakage of from 0 cc to 10 cc per minute; and CC denotes a leakage of greater than 10 cc per minute. Five spark plugs belonging to each of plugs A, B, and C were tested. As seen from Table 1, leakage increases with ambient temperature. This is conceivably because, as ambient temperature increases, the metallic shell 5 thermally expands in the axial direction; consequently, the packing pressure exerted on the packing member 6 decreases.

As seen from comparison of the test results between plugs A and C in Table 1, spark plugs belonging to plug A show markedly better impact resistance as compared to those belonging to plug C. Because of absence of the cushion-material charged portion 9, the spark plugs belonging to plug C show a significant impairment in airtightness as measured after the impact test. Even at room temperature, more than half of the spark plugs belonging to plug C are marked with CC with respect to airtightness. By contrast, the spark plugs belonging to plug A, which have the cushion-material charged portion 9, are all marked with AA at an ambient temperature of up to 50° C. Even at an ambient temperature of 100° C., more than half of the spark plugs belonging to plug A are marked with AA, indicating that those belonging to plug A are sufficiently applicable to practical use.

As seen from comparison of the test results between plugs A and B in Table 1, spark plugs belonging to plug B, which are hot-swaged, show better impact resistance as compared to those belonging to plug A, which are cold-swaged. The spark plugs belonging to plug A are all marked with AA at an ambient temperature of up to 50° C., whereas the spark plugs belonging to plug B are all marked with AA at an ambient temperature of up to 150°0 C. Moreover, those belonging to plug B are all marked with BB at an ambient temperature of up to 200° C., indicating that those belonging to plug B exhibit excellent impact resistance.

Next, swelling of the hexagonal portion 5A associated with swaging will be verified. Accurate measurement of the width-across-flats W was carried out with respect to two kinds of spark plugs which had been manufactured through use the swaging dies 41 and 42 such that the amount of buckling of the curved portion 5D becomes 0.8 mm. One kind of spark plugs, which are categorized as plug A, had the cushion-material charged portion 9 and were subjected to cold swaging. The other kind of spark plugs, which are categorized as plug B, had the cushion-material charged portion 9 and were subjected to hot swaging. The width-across-flats W is 14 mm nominally and 13.70 mm as measured before swaging. Ten spark plugs belonging to each of plugs A and B were measured for the width-across-flats W in mm. The results are shown in Table 2.

TABLE 2

| Width-across-flats W of Hexagonal Portion at 0.8 mm Buckling of Curved Portion | | |
|---|---|---|
| Plug | Plug A With talc Cold swaged | Plug B With talc Hot swaged |
| No. 1 | 13.924 | 13.790 |
| No. 2 | 13.957 | 13.775 |
| No. 3 | 13.980 | 13.792 |
| No. 4 | 13.923 | 13.795 |
| No. 5 | 13.928 | 13.796 |
| No. 6 | 13.962 | 13.795 |
| No. 7 | 13.988 | 13.788 |
| No. 8 | 14.001 | 13.783 |
| N9. 9 | 13.968 | 13.791 |
| No. 10 | 13.991 | 13.789 |
| Average | 13.962 | 13.789 |

As seen from Table 2, spark plugs belonging to plug A have an average, width-across-flats W of 0.262 mm and show considerable variations in the width-across-flats W. The width-across-flats W of spark plug No. 8 belonging to plug A is 0.001 mm beyond the tolerance. By contrast, in the case of spark plugs belonging to plug B, swelling of the width-across-flats W is as small as an average of 0.089 mm, and variations in the width-across-flats W are slight. Accordingly, even when the width-across-flats W as measured before swaging is increased by 0.1 mm, the width W as measured after swaging may sufficiently fall within the tolerance. Through buckling of the curved portion 5D effected while the curved portion 5D is heated and softened through application of current thereto, swelling of the hexagonal portion 5A can be reduced to a practically acceptable extent.

The spark plugs belonging to plugs A, B, and C mentioned above were examined for hot airtightness as measured after they were tightened at an excessive torque. Conceivably, when a spark plug is tightened at an excessive torque, the male-threaded portion 5B of the metallic shell 5 is stretched axially; as a result, the packing pressure exerted on the packing member 6 held between the inner circumferential stepped portion 5E and the insulator 1 decreases with a resultant impairment in airtightness. A rated torque for a spark plug having the male-threaded portion 5B of M12 and a width-across-flats W of 14 mm is 25 N-m (newton-meter).

The rated torque is defined as a torque required to tighten the male-threaded portion 5B which is not coated with anything. However, in this test, in order to establish severer conditions, an anti-seizing agent, or a lubricant, which contains molybdenum was applied to the male-threaded portion 5B, and each spark plug was tightened. The tightening torque was varied from 25 N-m to 65 N-m. The hot airtight test was conducted in the following manner. The seat temperature was increased to 200° C., arid an air pressure of 15 kgf/cm$^2$ was applied to the spark portion. Air leakage from the interior of each spark plug was measured. Specifically, air leakage along the packing member 6 and air leakage through the clearance between the metallic shell 5 and the insulator 1 of each spark plug were measured. The results are shown in Tables 3 and 4. Table 3 shows air leakage along the packing member 6, and Table 4 shows air leakage through the clearance between the metallic shell 5 and the insulator 1.

TABLE 3

| Hot Airtightness as Measured after Tightening at Excessive Torque Air Leakage along Packing Member | | | | | | | | | |
|---|---|---|---|---|---|---|---|---|---|
| Tightening torque | 25 | 30 | 35 | 40 | 45 | 50 | 55 | 60 | 65 |
| N-m | | | | | | | | | |
| plug A | AA | AA | AA | AA | AA | AA | BB | BB | BB |
| | AA | AA | AA | AA | AA | BB | BB | BB | CC |
| | AA | AA | AA | AA | AA | AA | BB | BB | CC |
| Plug B | AA | AA | AA | AA | AA | AA | AA | AA | AA |
| | AA | AA | AA | AA | AA | AA | AA | AA | AA |
| | AA | AA | AA | AA | AA | AA | AA | AA | AA |
| Plug C | AA | AA | BB | BB | CC | CC | CC | CC | CC |
| | AA | BB | BB | CC | CC | CC | CC | CC | CC |
| | AA | BB | BB | CC | CC | CC | CC | CC | CC |

TABLE 4

| Hot Airtightness as Measured after Tightening at Excessive Torque Air Leakage to Exterior of Spark Plug | | | | | | | | | |
|---|---|---|---|---|---|---|---|---|---|
| Tightening torque | 25 | 30 | 35 | 40 | 45 | 50 | 55 | 60 | 65 |
| N-m | | | | | | | | | |
| plug A | AA | AA | AA | AA | AA | AA | AA | AA | AA |
| | AA | AA | AA | AA | AA | AA | AA | AA | AA |
| | AA | AA | AA | AA | AA | AA | AA | AA | AA |
| Plug B | AA | AA | AA | AA | AA | AA | AA | AA | AA |
| | AA | AA | AA | AA | AA | AA | AA | AA | AA |
| | AA | AA | AA | AA | AA | AA | AA | AA | AA |
| Plug C | AA | AA | BB | BB | CC | CC | CC | CC | CC |
| | AA | BB | BB | CC | CC | CC | CC | CC | CC |
| | AA | AA | BB | BB | CC | CC | CC | CC | CC |

Tables 3 and 4 show the test results with respect to three spark plugs belonging to each of plugs A, B, and C. Symbols AA, BB, and CC hold the same meaning as in the case of Table 1. Specifically, AA denotes a leakage of 0 cc per minute; BB denotes a leakage of from 0 cc to 10 cc per minute; and CC denotes a leakage of grater than 10 cc per minute.

As seen from Table 3, spark plugs belonging to plug A, which have the cushion-material charged portion 9, show markedly better hot airtightness as compared to those belonging to plug C, which do not have the cushion-material charged portion 9. As mentioned previously, a spring force induced by a radially outward, elastic deformation of the hexagonal portion 5A of the metallic shell 5 is converted to a pressure of the talc powder 9. This pressure presses elastically the outer circumferential stepped portion 1D of the insulator 1 in the downward direction in FIG. 2. Thus, conceivably, even when the male-threaded portion 5B is stretched to some extent due to tightening at an excessive torque, the insulator 1 moves downward following the stretch, thereby maintaining airtightness in the position of the packing member 6.

As seen from comparison of the test results between plugs A and B in Table 3, the spark plugs belonging to plug B, which are hot-swaged, show better hot airtightness. Since a load required for hot swaging is 30% or more lower than that required for cold swaging, as mentioned previously with reference to Table 2, the spark plugs belonging to plug B exhibit a smaller amount of plastic deformation with respect to the hexagonal portion 5A. Thus, the spark plugs belonging to plug B conceivably exhibit a larger amount of elastic deformation with respect to the hexagonal portion 5A.

As seen from comparison between Table 3 and Table 4, the spark plugs belonging to plug C, which do not have the cushion-material charged portion 9, show little change in hot airtightness. By contrast, in the case of the spark plugs belonging to plugs A and B, which have the cushion-material charged portion 9, hot airtightness shown in Table 4 exhibits apparent improvement from that shown in Table 4. In the case of plug C as shown in FIG. 4, because of absence of the cushion-material charged portion 9, air which has leaked along the packing member 6 leaks through the clearance between the metallic shell 5 and the insulator 1. By contrast, in the case of plugs A and B as shown in FIG. 2, the cushion-material charged portion 9 serves as a second packing and prevents air which has leaked along the packing member 6, from leaking through the clearance between the metallic shell 5 and the insulator 1.

Figure 5B:
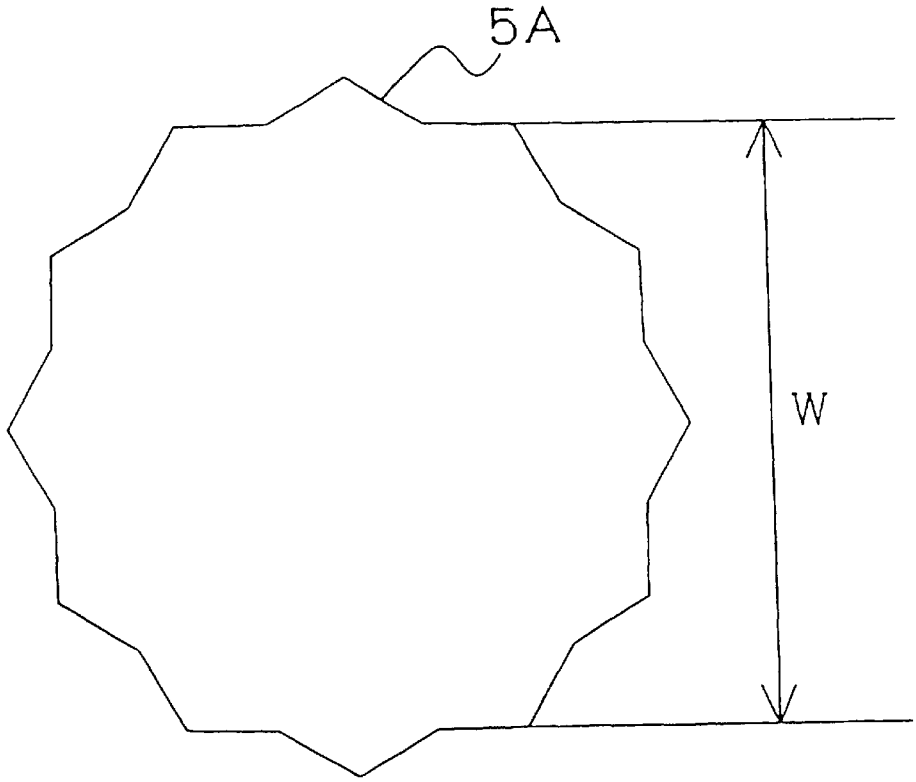
FIG. 5B is a schematic plan view of the hexagonal portion of FIG. 5A formed into a 12-point nut profile.

The above embodiment is described while mentioning as the tightening portion of the present invention the hexagonal portion 5A having an hexagon-nut profile as shown in FIG. 5A. However, the present invention is not limited thereto. The tightening portion may assume a 12-point (bi-hexagon) nut profile as shown in FIG. 5B.

It will be apparent to those skilled in the art that various modifications and variations can be made in the spark plug of the present invention and in construction of this spark plug without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A spark plug comprising:

an insulator having a center through-hole formed therein;

a center electrode held in the center through-hole;

a metallic shell holding the insulator by swaging and having a male-threaded portion formed on an outer circumferential surface of a front end portion of the metallic shell and a tightening portion formed on an outer circumferential surface of the metallic shell, located at a rear side with respect to the male-threaded portion; and a ground electrode electrically connected to the metallic shell and defining a spark discharge gap in cooperation with the center electrode, wherein the distance between two opposed parallel surfaces of the tightening portion is not greater than 14 mm, a cushion material is charged into a cylindrical space defined by an outer surface of the insulator and an inner surface of the metallic shell to thereby form a cushion-material charged portion, and the cushion-material charged portion has an axial length L of from 0.5 mm to 10.0 mm inclusive (0.5 mm$\leqq$L$\leqq$10.0 mm) and a thickness M of from 0.5 mm to 1.3 mm inclusive (0.5 mm$\leqq$M$\leqq$1.3 mm).

2. A spark plug according to claim 1, wherein the metallic shell has a seat portion located between the male-threaded portion and the tightening portion and having a diameter greater than a diameter of the male-threaded portion, and a curved portion extending between the tightening portion and the seat portion, the curved portion being buckled by axial swaging while being heated, so as to integrate the metallic shell and the insulator into a single unit.

3. A spark plug comprising:

an insulator having a center through-hole formed therein;

a center electrode held in the center through-hole;

a metallic shell holding the insulator, the metallic shell having a male-threaded portion formed on an outer circumferential surface of a front end portion of the metallic shell, a tightening portion formed on an outer circumferential surface of the metallic shell, a seat portion located between the male-threaded portion and the tightening portion and having a diameter greater than that of the male-threaded portion, and a curved portion extending between the tightening portion and the seat portion, the metallic shell being formed such that a distance between two opposed parallel surfaces of the tightening portion is not greater than 14 mm, the curved portion being buckled by pressing the tightening portion and the seat portion toward each other while heating the curved portion;

a cushion material charged into a cylindrical space defined by an outer surface of the insulator and an inner surface of the metallic shell to thereby form a cushion-material charged portion having an axial length L of from 0.5 mm to 10.0 mm inclusive (0.5 mm$\leqq$L$\leqq$10.0 mm) and a thickness M of from 0.5 mm to 1.3 mm inclusive (0.5 mm $\leqq$M$\leqq$1.3 mm); and a ground electrode electrically connected to the metallic shell.

4. A spark plug made by a method comprising:

forming a metallic shell having a male-threaded portion, a tightening portion, a seat portion located between the male-threaded portion and the tightening portion and having a diameter greater than that of the male-threaded portion, a curved portion extending between the tightening portion and the seat portion, and a distance between two opposed parallel surfaces of the tightening portion is not greater than 14 mm;

charging a cushion material into a cylindrical space defined by an outer surface of an insulator and an inner surface of the metallic shell to thereby form a cushion-material charged portion having an axial length L of from 0.5 mm to 10.0 mm inclusive (0.5 mm$\leqq$L$\leqq$10.0 mm) and a thickness M of from 0.5 mm to 1.3 mm inclusive (0.5 mm$\leqq$M$\leqq$1.3 mm); and pressing the tightening portion and the seat portion toward each other while applying current thereto so as to heat the curved portion to buckle the curved portion.

* * * * *